US009088108B2

(12) United States Patent
Zhao et al.

(10) Patent No.: US 9,088,108 B2
(45) Date of Patent: Jul. 21, 2015

(54) ELECTRICAL CONNECTOR HAVING A PAIR OF METALLIC SHELLS

(71) Applicant: HON HAI PRECISION INDUSTRY CO., LTD., New Taipei (TW)

(72) Inventors: Jun Zhao, Shenzhen (CN); Jing-Jie Guo, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 2 days.

(21) Appl. No.: 14/142,944

(22) Filed: Dec. 30, 2013

(65) Prior Publication Data

US 2014/0187094 A1 Jul. 3, 2014

(30) Foreign Application Priority Data

Dec. 30, 2012 (CN) ..... 2012 2 0740836 U

(51) Int. Cl.

| | |
|---|---|
| ***H01R 24/00*** | (2011.01) |
| ***H01R 13/6581*** | (2011.01) |
| *H01R 12/71* | (2011.01) |
| *H01R 13/6594* | (2011.01) |

(52) U.S. Cl.

CPC ..... *H01R 13/6581* (2013.01); *H01R 12/716* (2013.01); *H01R 13/6594* (2013.01)

(58) Field of Classification Search

CPC .... H01R 13/46; H01R 13/514; H01R 13/506; H01R 13/508; H01R 12/7017; H01R 13/6581; H01R 13/6594; H01R 12/716

USPC ..... 439/626

See application file for complete search history.

(56) References Cited

U.S. PATENT DOCUMENTS

| | | | | |
|---|---|---|---|---|
| 7,922,535 | B1 * | 4/2011 | Jiang et al. | 439/607.35 |
| 8,011,956 | B1 * | 9/2011 | Yang et al. | 439/589 |
| 8,038,474 | B2 * | 10/2011 | Ju | 439/607.01 |
| 8,282,417 | B2 * | 10/2012 | Xiao | 439/607.36 |
| 8,292,662 | B2 * | 10/2012 | Yang et al. | 439/587 |
| 8,292,674 | B1 * | 10/2012 | Yang et al. | 439/660 |
| 2008/0182457 | A1 * | 7/2008 | Wu | 439/626 |
| 2011/0130019 | A1 * | 6/2011 | Lim et al. | 439/218 |
| 2012/0071026 | A1 | 3/2012 | Yang et al. | |
| 2014/0120775 | A1 * | 5/2014 | Yen et al. | 439/626 |

FOREIGN PATENT DOCUMENTS

| | | |
|---|---|---|
| CN | 201594647 | 12/2009 |
| TW | M383224 | 6/2010 |
| TW | M389967 | 9/2010 |
| TW | M432980 | 7/2012 |

* cited by examiner

*Primary Examiner* — Jean F Duverne

(74) *Attorney, Agent, or Firm* — Wei Te Chung; Ming Chieh Chang

(57) ABSTRACT

An electrical connector (100) includes an insulative housing (1), a plurality of terminals (2), a metal plate (3), a first metallic shell (4) and a second metallic shell (5). The first metallic shell has a pair of side walls (43). The second metallic shell includes a pair of side boards (52). Each side wall has a first portion (4301), a second portion (4302), an elastic fin (431) extending from the first portion and a first angle relative to the second portion. Each side board defines a window (521) and the elastic fin protrudes into the window and resists against a contour of the window at a plurality of resisting points (4321) for prohibiting a relative movement of the first metallic shell, with respect to the second metallic shell. Each elastic fin is located in a vertical plane and the degree of the first angle is between 0 and 90°.

13 Claims, 7 Drawing Sheets

ELECTRICAL CONNECTOR HAVING A PAIR OF METALLIC SHELLS

BACKGROUND OF THE INVENTION

1. Field of the Invention

The present invention relates generally to an electrical connector, and more particularly to an electrical connector having two metallic shells firmly fixed with each other.

2. Description of Related Arts

Universal Serial Bus (USB) interfaces are widely used in various electronic devices. In recent years, a micro USB interface is introduced to meet miniaturization requirement of electronic devices. Taiwan Utility Model No. M389967 discloses an electrical connector comprising an inner metallic shell, an insulative housing assembled to the metallic shell, and a plurality of terminals retained in the insulative housing. The insulative housing has a base portion and a tongue portion extending forwardly from the base portion. The tongue portion has a receiving space extending to the base portion. Each terminal has a contacting portion exposed in the receiving space. The electrical connector further has an outer metallic shell shielding the inner metallic shell. The outer metallic shell includes an upper shell having two opposite walls and a lower shell having a pair of plates formed on both sides. Each plate has a hole. Each wall of the upper shell has a bump engaging with the hole for stabile installation.

The electrical connector has three shells, which increases manufacture difficulty and assembling time.

An electrical connector having a pair of shells firmly fixed to each other is desired.

SUMMARY OF THE INVENTION

Accordingly, an object of the present invention is to provide an electrical connector having a pair of shells firmly fixed to each other and easily assembled.

To achieve the above object, an electrical connector comprising: an insulative housing having a base portion; a plurality of terminals retained in the insulative housing; a first metallic shell enclosing the insulative housing and having a pair of opposite side walls, each side wall having a first portion and a second portion; and a second metallic shell covering the first metallic shell and having a top board and a pair of side boards; wherein said side wall having an elastic fin extending from the first portion and forming a first angle relative to the second portion; each side board defining a window, said elastic fin protruding into the window and resisting against a contour of the window at a plurality of resisting points for prohibiting a relative movement of the first metallic shell, with the respect to the second metallic shell, each elastic fin located in a vertical plane and the degree of the first angle between 0 and 90°.

Other objects, advantages and novel features of the invention will become more apparent from the following detailed description when taken in conjunction with the accompanying drawings.

DETAILED DESCRIPTION OF THE PREFERRED EMBODIMENT

Figure 1:
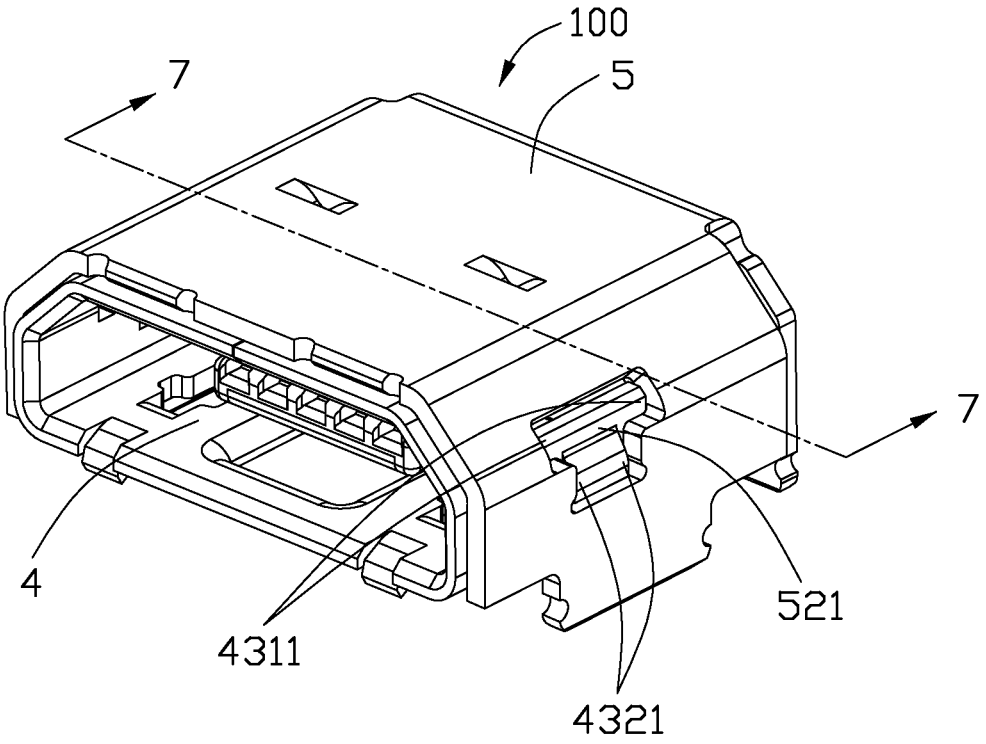
FIG. 1 is a perspective, assembled view of an electrical connector.

Reference will now be made in detail to the preferred embodiment of the present invention.

Referring to FIGS. 1 to 7, an electrical connector 100 of the present invention comprises an insulative housing 1, a plurality of terminals 2 received in the insulative housing 1, a metal plate 3 retained in the insulative housing 1, a first/inner metallic shell 4 enclosing the insulative housing 1 and a second/outer metallic shell 5 covering the first metallic shell 4.

Figure 5:
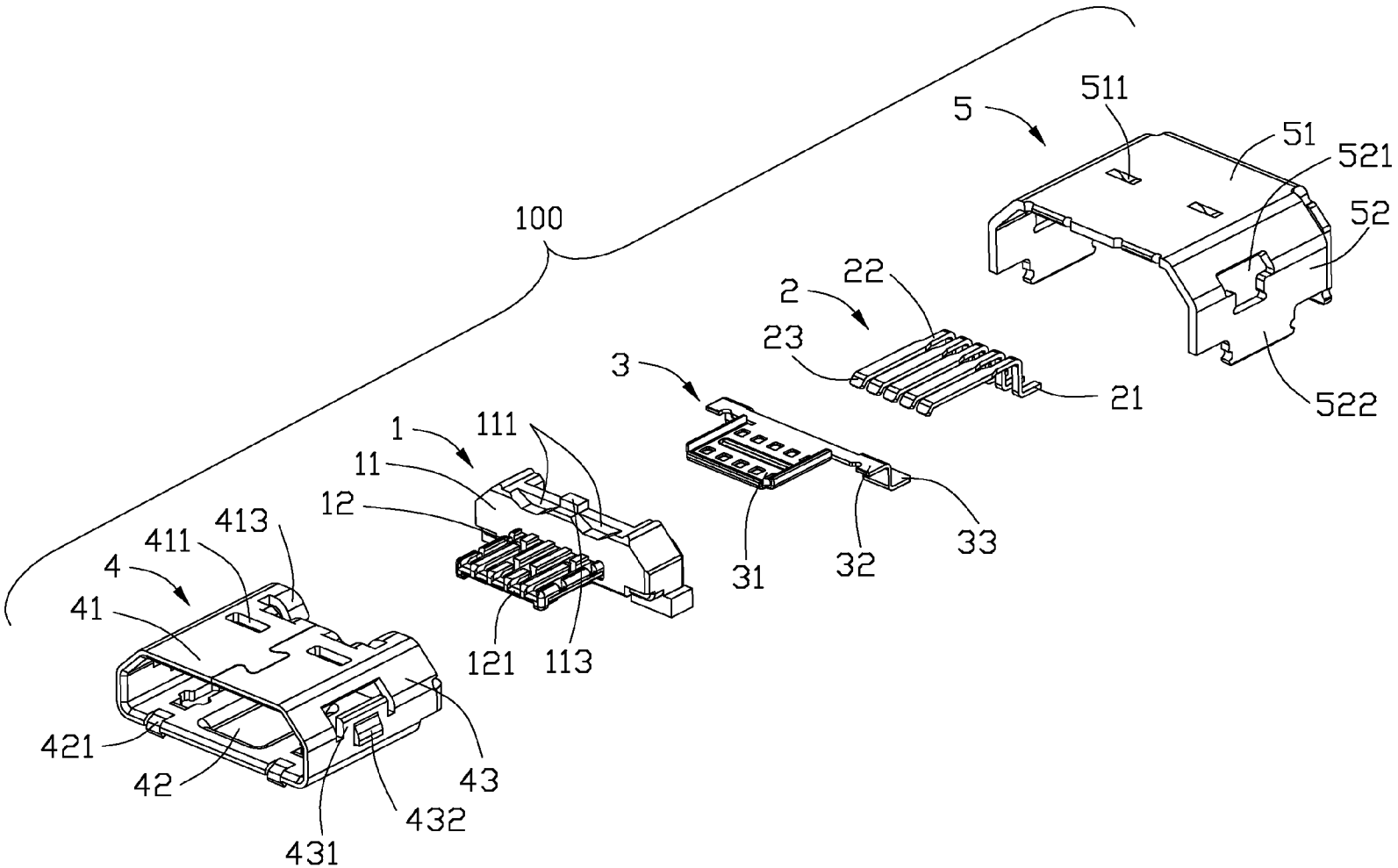
FIG. 5 is a perspective, exploded view of the electrical connector.
Figure 6:
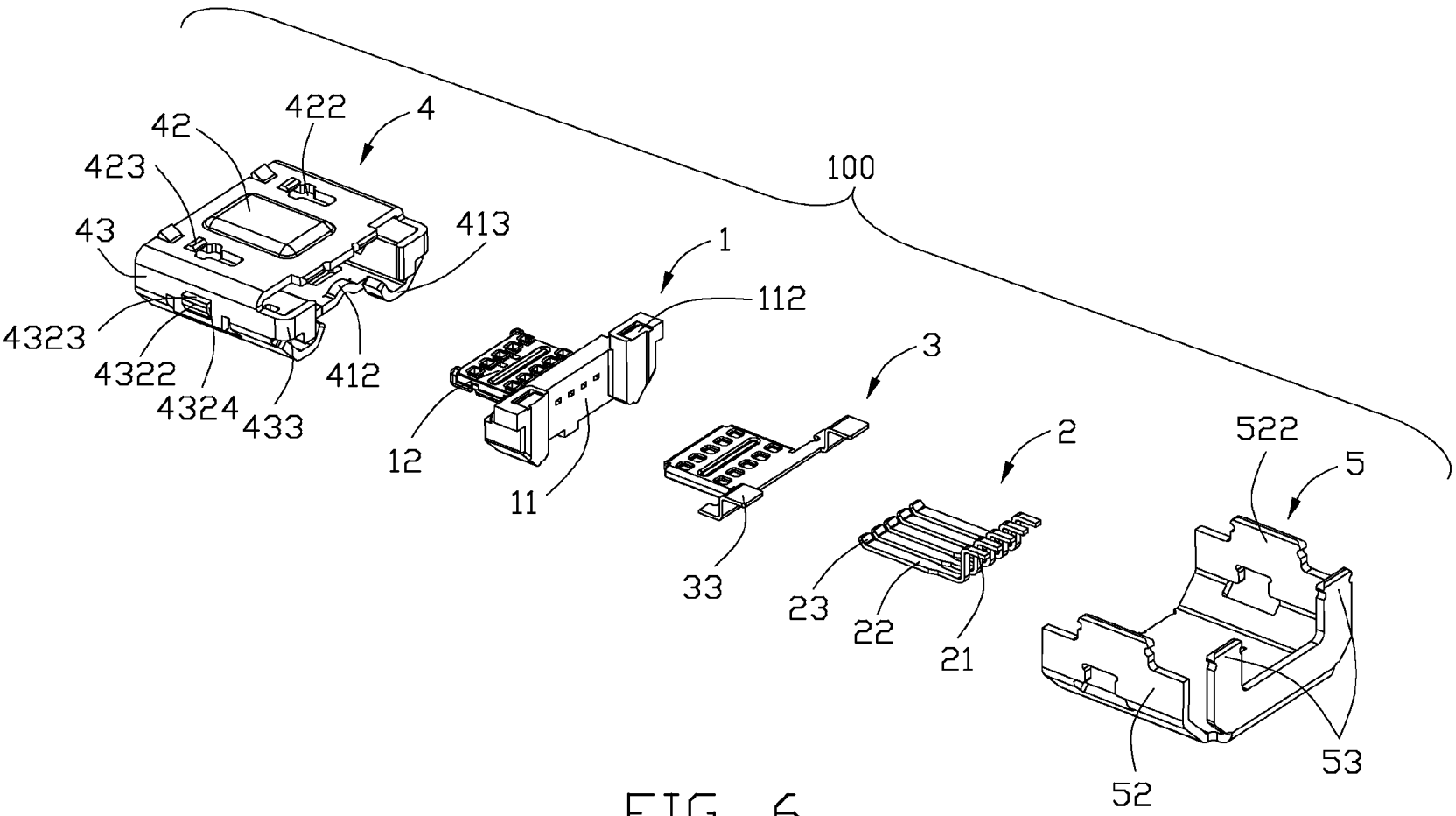
FIG. 6 is a perspective, exploded view of the electrical connector, taken from a different aspect with respect to FIG. 5.
Figure 7:
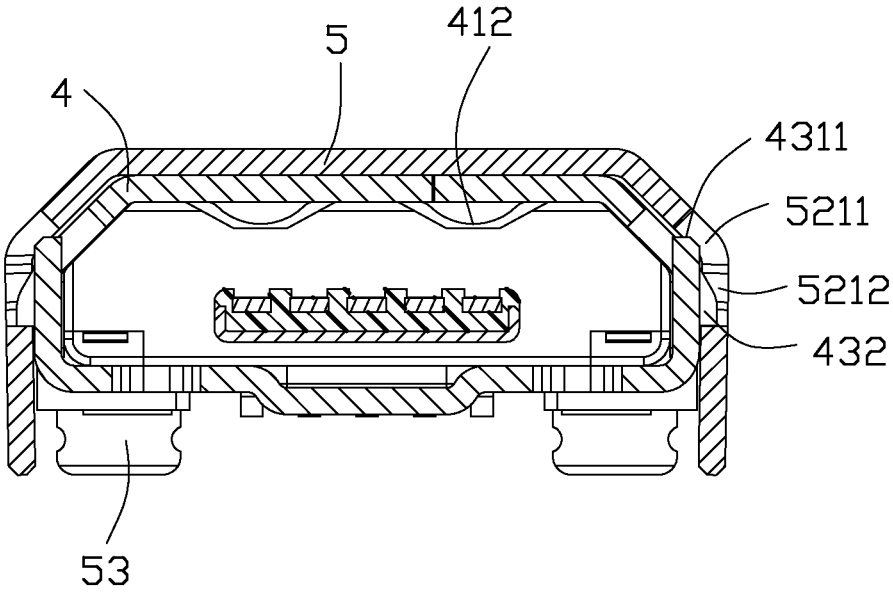
FIG. 7 is a cross sectional view taken along a line 7-7 in FIG. 1.

Referring to FIGS. 5 to 6, the insulative housing 1 comprises a base portion 11 and a tongue portion 12 extending from the base portion 11. A pair of hollows 111 is defined on the front of the top end of the base portion 11 and a bump 113 is formed behind the hollows 111 to cooperate with the first metallic shell 4. The insulative housing 1 further has two throughholes 112 extending through the base portion 10. The tongue portion 12 defines a number of receiving grooves 121 to receive the terminals 2.

The terminals 2 are insert-molded in the insulative housing 1 and each terminal 2 comprises a soldering portion 21 for soldering onto a printed circuit board, a fixing portion 22 received in the tongue portion 12 and a contacting portion 23 extending from the fixing portion 22.

Figure 2:
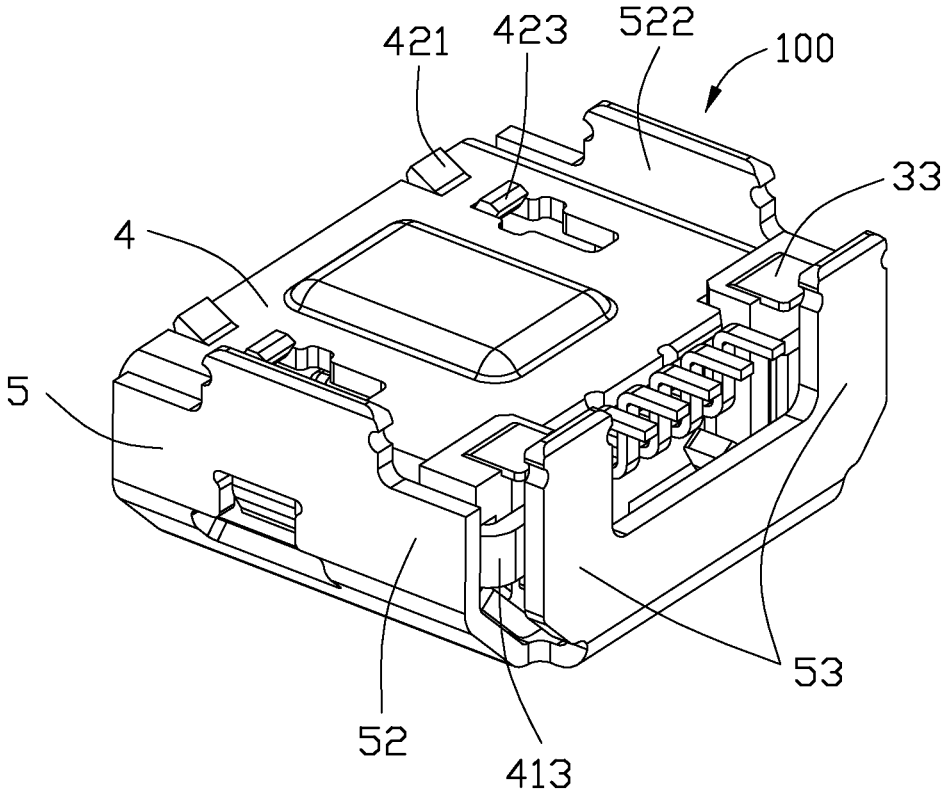
FIG. 2 is a perspective, assembled view of the electrical connector, taken from a different view with respect to FIG. 1.
Figure 3:
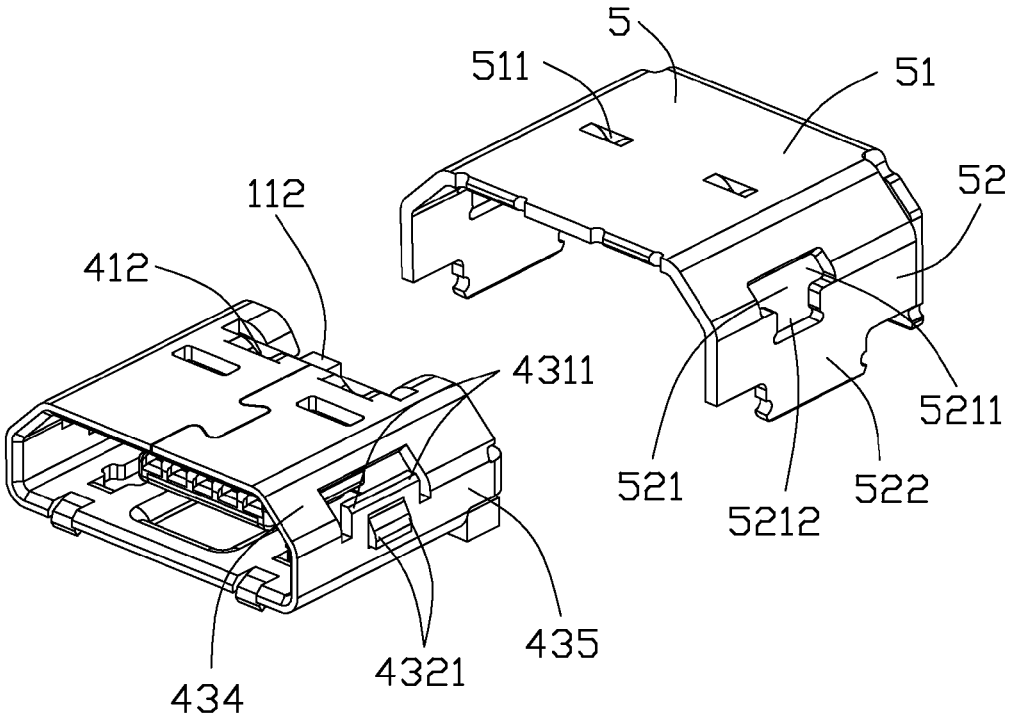
FIG. 3 is a perspective, partly exploded view of the electrical connector.

Referring to FIGS. 2 and 3, the metal plate 3 is insert-molded in the insulative housing 1. The metal plate 3 comprises a main portion 31 attached to the tongue portion 12, a pair of bent portions 32 extending rearwardly from the main portion 31, and a pair of positioning portions 33 formed at two distal ends of the bent portions 32. The bent portions 32 are inserted through the throughholes 11 and exposed on the insulative housing 12.

Figure 4:
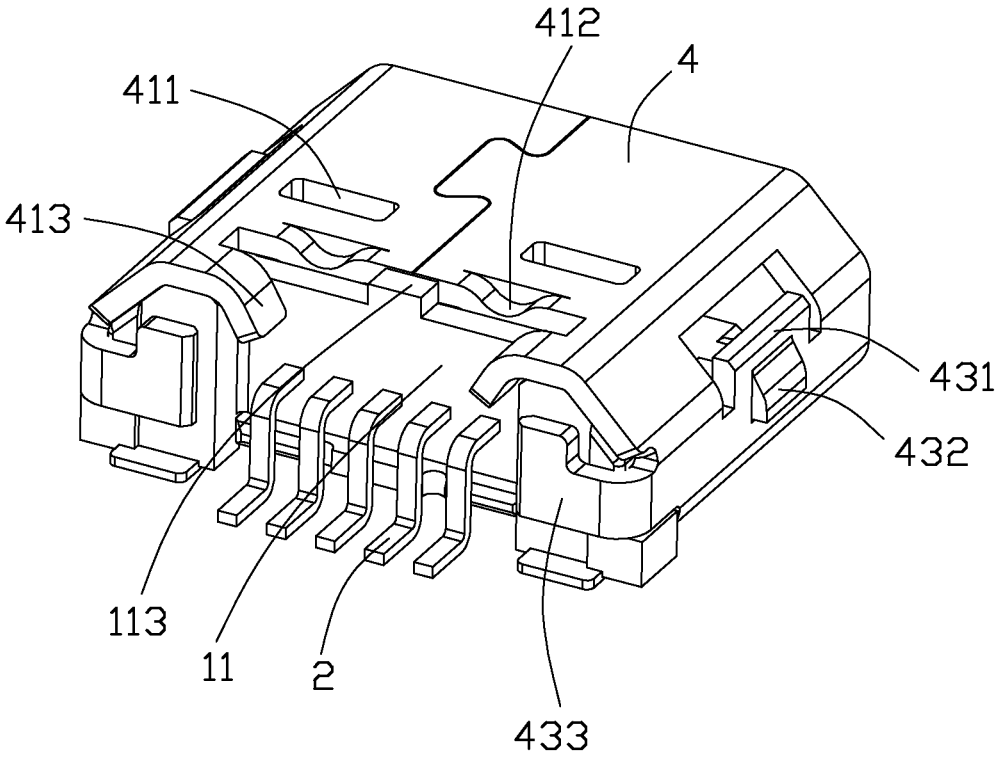
FIG. 4 is a perspective, partly assembled view of the electrical connector, with the second metallic shell being removed.

Referring to FIGS. 3 to 5, the first metallic shell 4 comprises a top wall 41, a bottom wall 42, and a pair of side walls 43 connecting the top wall 41 and the bottom wall 42. The top wall 41 defines a pair of punched apertures 411 and a pair of first projection 412 formed behind the apertures 411 to cooperate with the groove 111. The first metallic shell 4 further has a pair of gripping legs 413 bent inwardly from the rear end of the top wall 41 and clamping the end of the front surface of the base portion 11. The bottom wall 42 is formed with a plurality of guiding protrusions 421 and contacting slots 422 behind the guiding protrusions 421 for matching with the mating connector. The guiding protrusions 421 are formed symmetrically at the front edge of the bottom wall 42. The bottom wall 42 is formed with a pair of blocks 423 in front of the contacting slots 422 abutting against the counterpart of the mating connector. Each side wall 43 has a first portion or chamfered structure 4301 and a second portion 4302. Each side wall 43 has a vertical extension or elastic fin 431 extending from the first portion 4301 and formed with a first angle $\alpha$ relative to the second portion 4302. The degree of the first angle $\alpha$ is between 0 and 90°. The elastic fins 431 are respectively located in a vertical plane. Each side wall 43 has a bulge 432 protruding from the elastic fin 431, a plurality of the resisting points 4311 and abutting points 4321. Each bulge 432 is formed with a curved surface 4322, a pair of side surfaces 4324 and a bottom surface 4323 connecting the curved surface 4322 and the side surfaces 4324. The first metallic shell 4 also has a plurality of first fixed legs 433 bent inwardly, then extending forwardly from the rear end of the side walls 43, and perpendicular to the side walls 43.

Referring to FIGS. 3 to 6, the second metallic shell 5 comprises a top board 51, two opposite side boards 52 and a pair of second fixed legs 53. The top board 51 and the top wall 41 joint closely. The top board 51 is formed with stamp-formed second projections 511 projecting into the apertures 411 of first metallic shell 4. The second fixed legs 53 are bent downwardly from the top board 51 to shield the back-end of the base portion 11. Each side board 52 defines a window 521 including a first hole 5211 and a second hole 5212, and a metalsheet 522 extending downwardly from each side board 52. Each first hole 5211 is located above the second hole 5212. The bottom surface 4323 of each bulge 432 resists against the contour of the second holes 5212. The metalsheets 522 are fixed to the printed circuit board.

The insulative housing 1, the terminals 2 together with the metal plate 3 are insert-molded integrally. Then, the insulative housing 1 is assembled to the first metallic shell 4 rearwardly. Thus, first projection 412 cooperates against the groove 111 of base portion 11. The first fixed legs 433 shield a back-end of base portion 11. The gripping legs 413 abut against the end of the front surface of the base portion 11. The bump 113 resists against rear end of the top wall 41 The first metallic shell 4 stay relatively fixed to the insulative housing 1 along a front-to-back direction. The second metallic shell 5 covers the first metallic shell 4 along a top-to-bottom direction. The second fixed legs 53 of second metallic shell 5 shield the back of the first metallic shell 4. The second projections 511 engage with the apertures 411 of first metallic shell 4 for prohibiting relative movement between the second metallic shell 5 and the first metallic shell 4. Each elastic fin 431 protrudes into the window 521 and resists against a contour of the window 521 at a plurality of resisting points 4311 for prohibiting a relative movement of the first metallic shell 4, with the respect to the second metallic shell 5. The bulge 432 protrudes outwardly through the window 521 and abuts against the contour of the window 521 at a plurality of abutting points 4321 for prohibiting a relative movement of the first metallic shell 4, with the respect to the second metallic shell 5 along a front-to-back direction. Furthermore, the bottom surface 4323 of each bulge 432 is disposed against the second hole 5212 of each window 521 to guarantee the stability between the first and second metallic shell 4,5. In addition, the elastic fins 431 of the first metallic shell 4 also contribute to buffer and reducing damage. The resisting points 4311 are disposed around the first hole 5211, and the abutting points 4321 are disposed around the second hole 5212.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing having a base portion;

a plurality of terminals retained in the insulative housing;

a first metallic shell enclosing the insulative housing and having a pair of opposite side walls, each side wall having a first portion and a second portion; and a second metallic shell covering the first metallic shell and having a top board and a pair of side boards;

wherein said side wall having an elastic fin extending from the first portion and located in a vertical plane, said elastic fin forming a first angle between 0 and 90° relative to the second portion; each side board defining a window, said elastic fin protruding into the window and resisting against a contour of the window at a plurality of resisting points for prohibiting a relative movement of the first metallic shell, with the respect to the second metallic shell; wherein each elastic fin is formed with a bulge protruding outwardly through the window and abutting against the contour of the window at a plurality of abutting points for prohibiting a relative movement of the first metallic shell, with the respect to the second metallic shell along a front-to-back direction; each window has a first hole and a second hole located below the first hole, the resisting points are disposed around the first hole, and the abutting points are disposed around the second hole; wherein each bulge has a curved surface, a pair of side surfaces and a bottom surface connecting the curved surface and the side surfaces, and the bottom surface resists against the contour of the second hole.

2. The electrical connector as claimed in claim 1, wherein the first metallic shell has a top wall butting against the top board of said second metallic shell.

3. The electrical connector as claimed in claim 2, wherein the top wall is formed with a plurality of first projections, and the base portion is formed with a plurality of hollows engaging with the first projections.

4. The electrical connector as claimed in claim 2, wherein the first metallic shell is formed with a pair of gripping legs bent inwardly from rear end of the top wall and clamping an end of the front surface of the base portion, and the first metallic shell is further formed with a pair of first fixed legs bent inwardly, extending forwardly from the rear end of the side walls, and perpendicular to the side walls.

5. The electrical connector as claimed in claim 2, wherein the base portion is formed with a bump resisting against a rear-end of the top wall along the back-to-front direction.

6. The electrical connector as claimed in claim 1, wherein the second metallic shell is formed with a pair of second fixed legs bent downwardly from the top board to shield the base portion.

7. The electrical connector as claimed in claim 1, wherein the first metallic shell has a pair of apertures and the second metallic shell has a pair of second projections projecting into the apertures.

8. An electrical connector comprising:

an insulative housing defining a mating tongue;

a plurality of contacts disposed in the housing with contacting sections exposed upon the mating tongue in a vertical direction;

a first metallic shell enclosing the housing and defining a mating port in which said mating tongue extends forwardly in a front-to-back direction perpendicular to said vertical direction, said first metallic shell including opposite top and bottom walls and a pair of opposite side walls commonly defining said mating port, a pair of first chamfered structures being formed between the top wall and the corresponding side walls, respectively;

a second metallic shell including a pair of opposite side boards joined with each other via a top board, a pair of second chamfered structures being formed between the top board and the corresponding side boards, respectively, the second metallic shell being configured to be downwardly assembled unto the first metallic shell in the vertical direction wherein the top board confronts the top wall in the vertical direction and the pair of opposite sides boards confront the pair of corresponding side walls, respectively, in a transverse direction perpendicular to both said vertical direction and said front-to-back direction; and a pair of second windows each formed around a joint between the side board and the corresponding chamfered structure, each of said second windows defining an upper hole in which a vertical extension from the corresponding side wall is inserted, and a lower hole in which an outward bulge formed on the corresponding side wall is received; wherein the pair of first windows are formed around respective joints each located between the side wall and the corresponding chamfered structure, the pair of first windows are generally aligned with the pair of corresponding windows, respectively; wherein the pair of vertical extensions extend from bottom edges of the corresponding first windows in a deflectable manner, respectively.

9. The electrical connector as claimed in claim 8, wherein an upper portion of said outward bulge is formed on the corresponding vertical extension.

10. The electrical connector as claimed in claim 9, wherein said vertical extension is resilient.

11. The electrical connector as claimed in claim 8, wherein a lower portion of the outward bulge is formed on the corresponding side wall.

12. The electrical connector as claimed in claim 8, wherein the upper hole is transversely larger than the lower hole in the front-to-back direction.

13. An electrical connector comprising:

an insulative housing with a plurality of contacts therein;

an inner metallic shell enclosing the housing and defining at least a pair of side walls linked to each other via a top wall, each of said side walls linked to the top wall via an inner chamfered structure, an inner window formed in the inner chamfered structure; and an outer metallic shell enclosing the inner metallic shell and defining a pair of side boards linked to each other via a top board, each of said side boards linked to the top board via an outer chamfered structure, an outer window formed in the outer chamfered structure; wherein said inner window is overlapped with outer window in both a vertical direction and a transverse direction perpendicular to each other; wherein the extension extends from one edge of the inner window into the corresponding outer window; wherein said extension is elastic with a bulge thereon to be received in the corresponding outer window, and wherein said bulge extends in a direction perpendicular to a direction in which said extension extends.

* * * * *